US010124984B1

(12) United States Patent
Garvie

(10) Patent No.: US 10,124,984 B1
(45) Date of Patent: Nov. 13, 2018

(54) EXTENSION CORD SYSTEM

(71) Applicant: Allan Garvie, Hamilton, NJ (US)

(72) Inventor: Allan Garvie, Hamilton, NJ (US)

( * ) Notice: Subject to any disclaimer, the term of this patent is extended or adjusted under 35 U.S.C. 154(b) by 70 days.

(21) Appl. No.: 15/458,107

(22) Filed: Mar. 14, 2017

(51) Int. Cl.
*B65H 75/40* (2006.01)
*B65H 75/14* (2006.01)
*B65H 75/44* (2006.01)

(52) U.S. Cl.
CPC ..... *B65H 75/146* (2013.01); *B65H 75/40* (2013.01); *B65H 75/4492* (2013.01); *B65H 2701/34* (2013.01)

(58) Field of Classification Search
CPC .. B65H 75/40; B65H 75/146; B65H 75/4492; B65H 2701/34
See application file for complete search history.

(56) References Cited

U.S. PATENT DOCUMENTS 4,282,954 A 8/1981 Hill
5,855,262 A 1/1999 Jackson
6,273,354 B1 8/2001 Kovacik
6,779,749 B2 8/2004 Laporta
6,918,557 B2 * 7/2005 Ast ..... B65H 75/146 242/388.6
7,658,345 B2 * 2/2010 Wells ..... B65H 49/32 242/403.1
D624,020 S 9/2010 Kovacik
8,245,965 B2 * 8/2012 Andrea ..... B65H 49/18 242/118.41
8,444,078 B1 * 5/2013 Brown ..... B65H 75/40 242/403
9,126,802 B2 9/2015 Holmberg
9,166,346 B2 10/2015 Berger
2011/0300744 A1 12/2011 Garry
2013/0306781 A1 * 11/2013 Tong ..... B65H 75/146 242/388.1
2017/0313544 A1 * 11/2017 Parke ..... B65H 75/146

FOREIGN PATENT DOCUMENTS

EP 0462846 A2 12/1991

* cited by examiner

*Primary Examiner* — Sang K Kim

(57) ABSTRACT

The extension cord system comprises a cord reel and a cord. The cord is spooled and stored on the cord reel. The cord is an electrical cable that is further defined with a first end and a second end. The center, or midpoint, of the cord attaches to the cord reel in such a manner that the first end and the second end of the cord are: 1) simultaneously played out from the cord reel when the extension cord system is being deployed; and, 2) simultaneously spooled on to the cord reel when the extension cord system is being retracted.

3 Claims, 4 Drawing Sheets

EXTENSION CORD SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transporting, conveying, handling or storing thin or filamentary material, more specifically, an apparatus for storing filamentary material on a reel with two end flanges and one intermediate flange.

SUMMARY OF INVENTION

The extension cord system comprises a cord reel and a cord. The cord is spooled and stored on the cord reel. The cord is an electrical cable that is further defined with a first end and a second end. The center, or midpoint, of the cord attaches to the cord reel in such a manner that the first end and the second end of the cord are: 1) simultaneously played out from the cord reel when the extension cord system is being deployed; and, 2) simultaneously spooled on to the cord reel when the extension cord system is being retracted.

These together with additional objects, features and advantages of the extension cord system will be readily apparent to those of ordinary skill in the art upon reading the following detailed description of the presently preferred, but nonetheless illustrative, embodiments when taken in conjunction with the accompanying drawings.

In this respect, before explaining the current embodiments of the extension cord system in detail, it is to be understood that the extension cord system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the extension cord system.

It is therefore important that the claims be regarded as including such equivalent construction insofar as they do not depart from the spirit and scope of the extension cord system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

Figure 1:
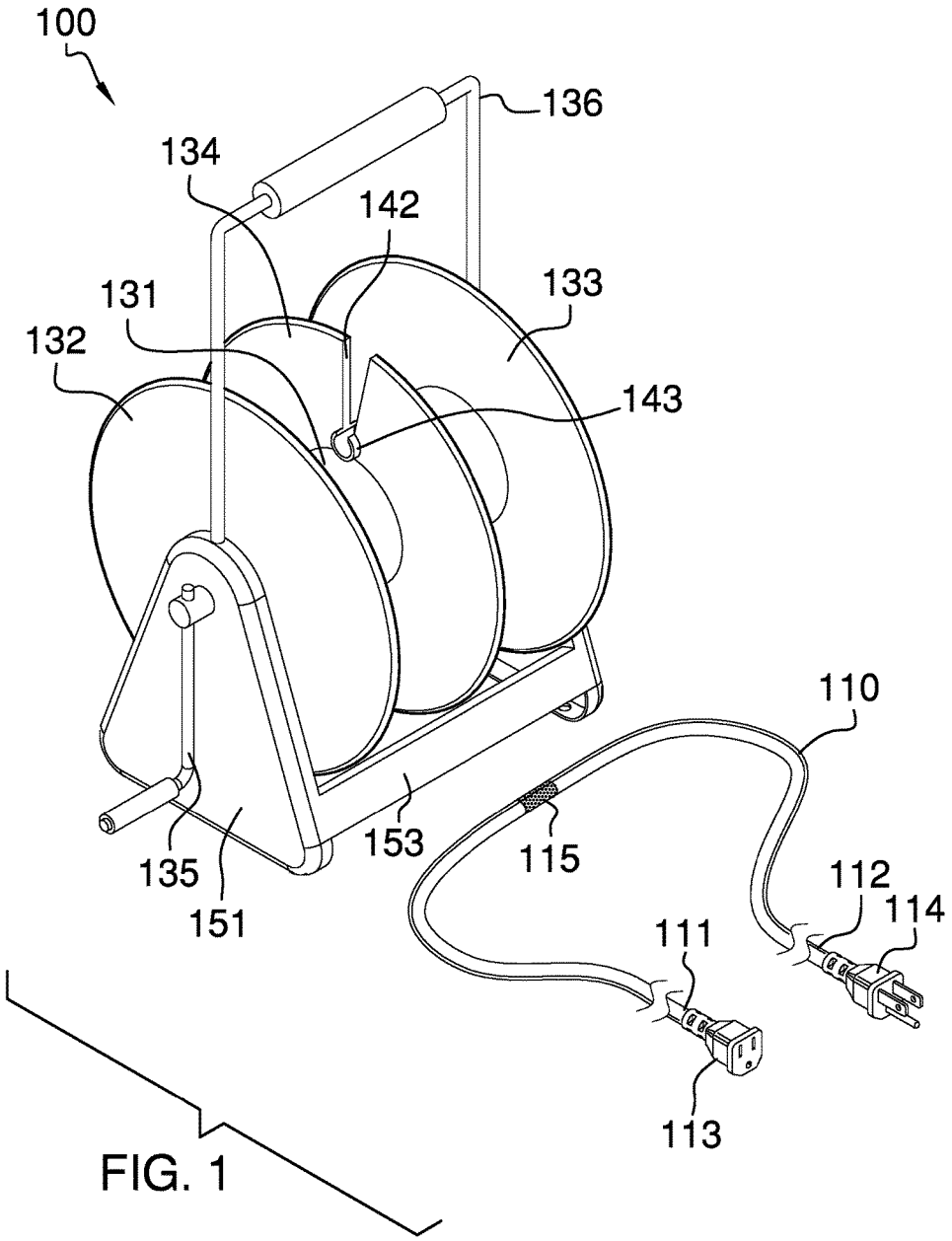
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 4.

The extension cord system 100 (hereinafter invention) comprises a cord reel 101 and a cord 102. The cord 102 is spooled and stored on the cord reel 101. The cord 102 is an electrical cable 110 that is further defined with a first end 111 and a second end 112. The center, or midpoint, of the cord 102 attaches to the cord reel 101 in such a manner that the first end 111 and the second end 112 of the cord 102 are: 1) simultaneously played out from the cord reel 101 when the invention 100 is being deployed; and, 2) simultaneously spooled on to the cord reel 101 when the invention 100 is being retracted.

The cord reel 101 is a storage device upon which the cord 102 is stored and from which the cord 102 played out and on to which the cord 102 is retracted. The cord reel 101 comprises a bifurcated spool 121 and a stand 122.

The bifurcated spool 121 is a spool upon which the cord 102 is stored. The bifurcated spool 121 comprises a first end flange 132 storage location and a second end flange 133 storage location within and between which the cord 102 is equally divided during storage. The bifurcated spool 121 comprises a drum 131, a first end flange 132, a second end flange 133, a bifurcating flange 134, a crank 135, and a handle 136. The first end flange 132 is further defined with a flange diameter 145. The second end flange 133 is further defined with a flange diameter 145. The bifurcating flange 134 is further defined with a flange diameter 145. The flange diameter 145 refers to the diameter of the faces of each of the first end flange 132, the second end flange 133, and the bifurcating flange 134. The spans of the flange diameter 145 of each of the first end flange 132, the second end flange 133, and the bifurcating flange 134 are identical. The first end flange 132 and the second end flange 133 are identical.

The drum 131 is a structure shaped as a right cylinder. The drum 131 forms the surface upon which the cord 102 is spooled on to the bifurcated spool 121. The drum 131 comprises a drum shaft 141.

The first end flange 132 is a circular disk that attaches to a base of the cylindrical structure that forms the drum 131. The first end flange 132 prevents the cord 102 form falling off the drum 131 in a lateral motion. The second end flange 133 is a circular disk that attaches to the base of the cylindrical structure that forms the drum 131 that is distal from the first end flange 132. The second end flange 133 prevents the cord 102 form falling off the drum 131 in a lateral motion.

The bifurcating flange 134 is a circular disk that attaches to the drum 131. The bifurcating flange 134 is positioned on the drum 131 such that the faces of the bifurcating flange 134 are parallel to the faces of the first end flange 132 and the second end flange 133. The bifurcating flange 134 is positioned on the drum 131 such that the span of the distance from the bifurcating flange 134 to the first end flange 132 equals the span of the distance from the bifurcating flange 134 to the second end flange 133. The bifurcating flange 134 divides the bifurcated spool 121 into the first end flange 132 storage location and the second end flange 133 storage location. The bifurcating flange 134 comprises a slot 142 and a notch 143. The slot 142 is further defined with an inner dimension 144.

The crank 135 is a shaft that is used to rotate the drum 131 around an axis of rotation formed by the drum shaft 141. The handle 136 is a grip that is used to hand carry the bifurcated spool 121. The design and use of cranks 135 and handles 136 are well known and documented in the transportation and mechanical arts.

The drum shaft 141 is a cylindrical shaft that is attached to the drum 131 such that the center axis of the drum shaft 141 is aligned with the center axis of the drum 131. The drum shaft 141 extends beyond the first end flange 132 in a direction away from the drum 131. The drum shaft 141 extends beyond the second end flange 133 in a direction away from the drum 131. The drum shaft 141 attaches to the crank 135 such that the drum shaft 141 forms a crankshaft that rotates the drum 131 such that the axis of rotation of the drum 131 is aligned with the center axis of the drum 131.

The slot 142 is a radial groove that is formed through the faces of the bifurcating flange 134 such that the slot 142 forms an opening in the circumference of the bifurcating flange 134. The notch 143 is an opening that is formed at the junction of the drum 131 and the slot 142. The notch 143 projects in an approximately perpendicular direction from the slot 142. The inner dimension 144 is the span of the negative space formed by the slot 142. The inner dimension 144 is measured in a direction that is perpendicular the radial axis of the slot 142.

The stand 122 is a structural frame that supports the bifurcated spool 121 above the supporting surface 171 such that the bifurcated spool 121 can be rotated to play out and retract the cord 102 on to and off of the bifurcated spool 121. The stand 122 comprises a first triangular plate 151, a second triangular plate 152, a first cross brace 153, and a second cross brace 154.

The first triangular plate 151 and the second triangular plate 152 are identical. The first triangular plate 151 is further defined with a height 157. The second triangular plate 152 is further defined with a height 157 the span of which is identical to the span of the height 157 of the first triangular plate 151. The height 157 is the perpendicular vertical distance as measured from the vertex of a selected triangular plate. The selected vertex is the vertex that is distal to the supporting surface 171. The triangular plate is selected from the group consisting of the first triangular plate 151 and the second triangular plate 152. It is anticipated that the span of the height 157 is independent of the selected triangle. In all cases and comparisons, the span of the height 157 is greater than the span of the flange diameter 145.

The first triangular plate 151 is a triangular plate structure that supports the first end flange 132 of the bifurcated spool 121. The first triangular plate 151 further comprises a first bearing 155. The second triangular plate 152 is a triangular plate structure that supports the second end flange 133 of the bifurcated spool 121. The second triangular plate 152 further comprises a second bearing 156.

The first bearing 155 is a bearing that is mounted through the first triangular plate 151 such that the first bearing 155 supports an end of the drum shaft 141 in such a manner that the drum shaft 141 can be connected to the crank 135. The first bearing 155 is mounted proximal to a third vertex of the first triangular plate 151 that is distal from the supporting surface 171. The second bearing 156 is a bearing that is mounted on the second triangular plate 152 such that the first bearing 155 supports an end of the drum shaft 141. The second bearing 156 is mounted proximal to a third vertex of the second triangular plate 152 that is distal from the supporting surface 171.

The first cross brace 153 is a strut that attaches a first vertex of the first triangular plate 151 to the corresponding vertex of the second triangular plate 152. The second cross brace 154 is a strut that attaches a second vertex of the first triangular plate 151 to the corresponding vertex of the second triangular plate 152.

Figure 2:
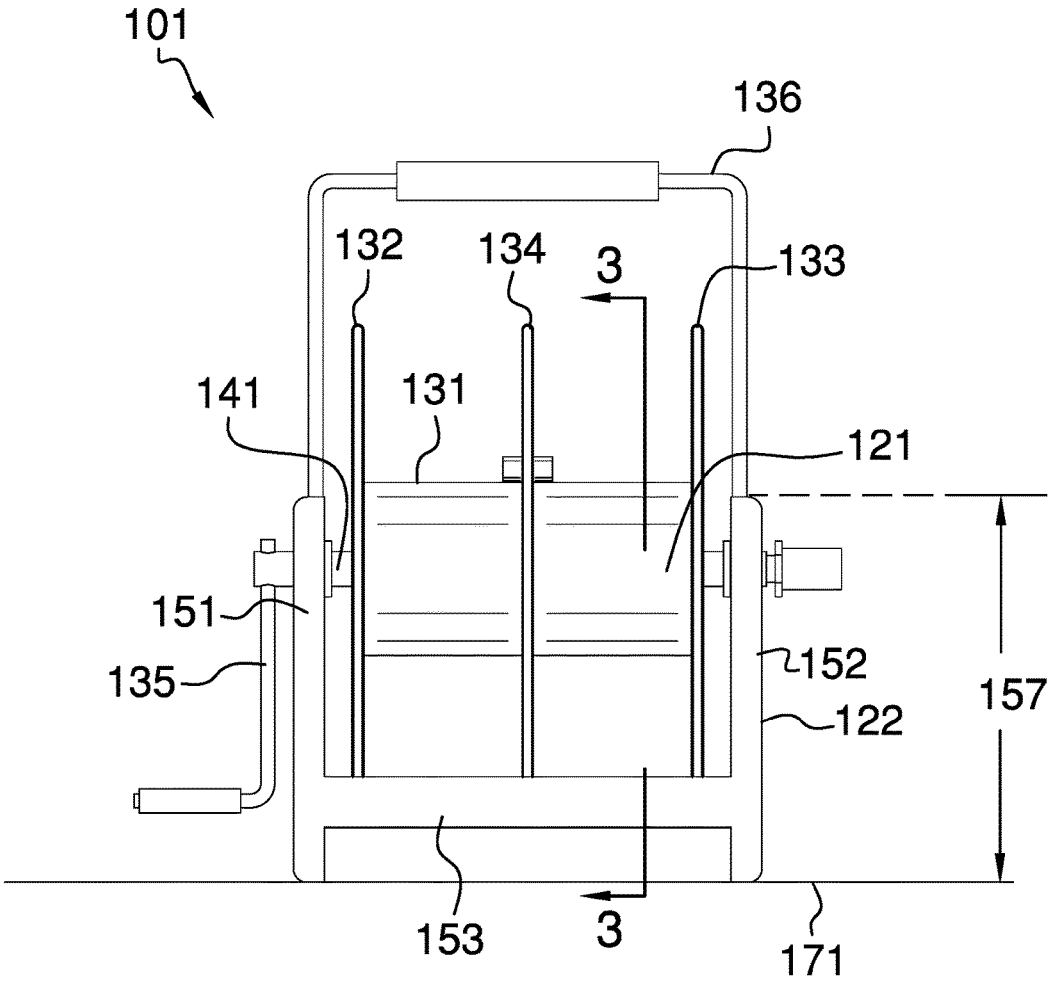
FIG. 2 is a front view of an embodiment of the disclosure.
Figure 3:
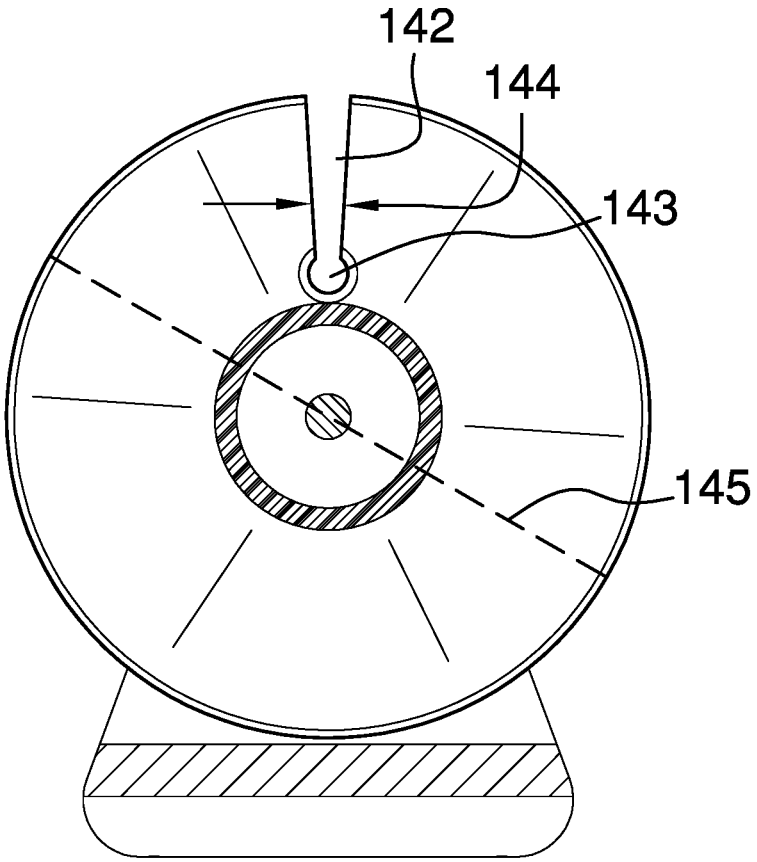
FIG. 3 is a cross-sectional view of an embodiment of the disclosure across 3-3 as shown in FIG. 2.
Figure 4:
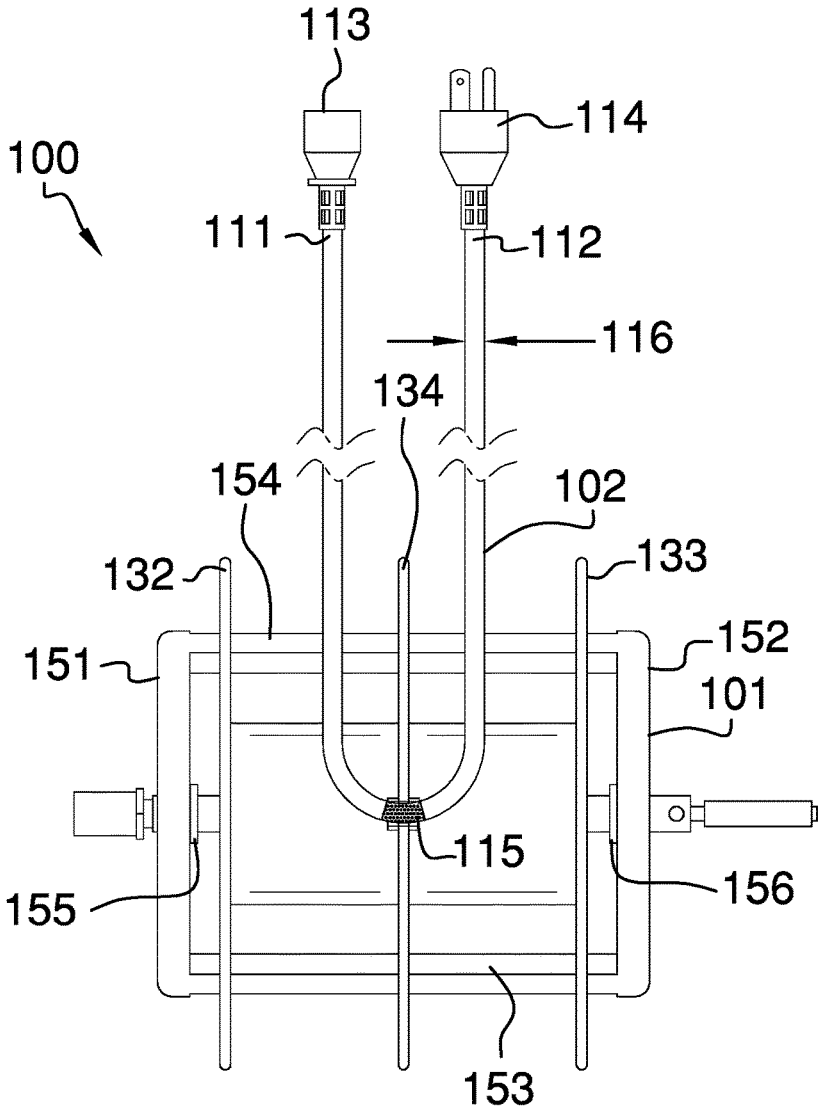
FIG. 4 is a top view of an embodiment of the disclosure.

As shown most clearly in FIGS. 1 and 2, the first triangular plate 151, the second triangular plate 152, the first cross brace 153, and the second cross brace 154 form the foundation of the stand 122 that rests upon the supporting surface 171.

The cord 102 refers to a long, thin, and flexible piece of string, line, rope, wire, or cable. The cord 102 has the flexibility needed to enable the cord 102 to be wrapped around a cylindrical structure. As a practical matter, it is expected that the cord 102 will have a predictable tensile strength but a negligible compressive strength. It is further expected that the cord 102 will exhibit random and variable behaviors when subjected to a compressive force. Stated less formally, this compressive behavior is best described by the engineering adage "you can't push a rope."

The cord 102 further comprises a center mark 115. The cord 102 is further defined with a first end 111, a second end 112, and an outer dimension 116. The outer dimension 116 is a measure of the diameter across the cord 102. The span of the outer dimension 116 of the cord 102 is lesser than the inner dimension 144 of the slot 142 such that the cord 102 can be inserted into the slot 142. The outer dimension 116 is a measure of the diameter across the cord 102. The center mark 115 is an image that is formed on the cord 102. The center mark 115 identifies the linear center point of the cord 102 such that the span of the distance from the center mark 115 to the first end 111 equals the span of the distance from the center mark 115 to the second end 112. The center mark 115 of the cord 102 is inserted into the slot 142 for the purpose of: 1) attaching the center of the cord 102 to the drum 131; and, 2) dividing the cord 102 equally between the first end flange 132 storage location and the second end flange 133 storage location. The center mark 115 of the cord 102 is placed in the notch 143 in order to secure the cord 102 to the cord reel 101. The cord 102 is further defined with a first end 111, a second end 112, and an outer dimension 116. The span of the outer dimension 116 of the cord 102 is lesser than the inner dimension 144 of the slot 142 such that the cord 102 can be inserted into the slot 142.

In the first potential embodiment of the disclosure, the cord 102 comprises an electrical cable 110, a first termination 113, and a second termination 114. The electrical cable 110 is an electrically conductive structure that: 1) comprises a collection of individually insulated electrically conductive wires; that are, 2) that are further contained within a protective and insulating casing.

The first termination 113 is a commercially available electrical device that makes an electrical connection with an externally provided object selected from the group consisting of an electrical device or an electrical power source. The second termination 114 is a commercially available electrical device that makes an electrical connection with an externally provided object selected from the group consisting of an electrical device or an electrical power source. In the first potential embodiment of the disclosure, the first termination 113 is a NEMA 5-15 electrical socket that is attached to the first end 111 of the electrical cable 110. The second termination 114 is a NEMA 5-15 electrical plug that is attached to the second end 112 of the electrical cable 110.

The following definitions were used in this disclosure:

Align: As used in this disclosure, align refers to an arrangement of objects that are: 1) arranged in a straight line; or, 2) arranged to give a directional sense of a plurality of parallel lines.

Bearing: As used in this disclosure, a bearing is a mechanical device that: 1) guides and limits the motion of a moving component relative to a fixed component; and, 2) reduces the friction between the moving component and the fixed component. The use of bearings is well known and documented in the mechanical arts.

Cable: As used in this disclosure, a cable is a collection of insulated wires covered by a protective casing that is used for transmitting electricity or telecommunication signals.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Center of Rotation: As used in this disclosure, the center of rotation is the point of a rotating plane that does not move with the rotation of the plane. A line within a rotating three dimensional object that does not move with the rotation of the object is also referred to as an axis of rotation.

Cord: As used in this disclosure, a cord is a long, thin, and flexible piece of string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, rope, wire, and cable are synonyms for cord.

Correspond: As used in this disclosure, the term correspond means that a first object is in some manner linked to a second object in a one to one relationship.

Crank: As used in this disclosure, a crank is a handle or an arm that is attached perpendicularly to the axis of rotation of a shaft and that is used for transmitting rotary motion to the shaft.

Crankshaft: As used in this disclosure, a crankshaft is a cylindrical rod or shaft that: 1) is designed to rotate around its center axis; and 2) is driven by a crank.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Disk: As used in this disclosure, a disk is a cylindrically shaped object that is flat in appearance.

Drum: Refers to a right circular cylinder or spool shaped object. The diameter of the drum refers to distance across the circular face of the drum. The circumference of the drum refers to the distance around the edge of the circular face of the drum. The length of the drum refers to the distance between the circular faces of the drum.

Drum Mount: Refers to the method that holds the drum in its operating position. As used here, the drum mount is designed to allow for the rotation of the drum and, optionally, may provide a connection to the drive.

Flange: As used in this disclosure, a flange is a collar that is used to hold an object in place.

Grip: As used in this disclosure, a grip is an accommodation formed within an object that allows the object to be grasped by a hand.

Handle: As used in this disclosure, a handle is an object by which a tool, object, or door is held or manipulated with the hand.

Inner Dimension: As used in this disclosure, the term inner dimension describes the span from a first inside or interior surface of a container to a second inside or interior surface of a container. The term is used in much the same way that a plumber would refer to the inner diameter of a pipe.

Negative Space: As used in this disclosure, negative space is a method of defining an object through the use of open or empty space as the definition of the object itself, or, through the use of open or empty space to describe the boundaries of an object.

NEMA 5-15 Electrical Socket: As used in this disclosure, the NEMA 5-15 electrical socket is a port designed to provide electric power drawn from the National Electric Grid. The NEMA 5-15 electrical socket is commonly used to deliver electrical power to electric devices in residential, office, and light industrial settings. The typical NEMA5-15 electrical socket comprises a plurality of electric ports from which electric power is drawn. The position of each of the plurality of electric ports is placed in a standardized position. The typical NEMA5-15 electrical socket further comprises a plate hole which is a standardized hole located in a standardized position within the NEMA 5-15 electrical socket that that is designed to receive a bolt that is used to attach a faceplate to the NEMA 5-15 electrical socket. The NEMA 5-15 electrical socket is also commonly referred to as an electrical outlet.

NEMA 5-15P Electrical Plug: As used in this disclosure, the NEMA 5-15P Electrical Plug is a plug that is designed to be inserted into a NEMA 5-15 Electrical Socket for the purpose of delivering electrical power to electrical devices. The NEMA 5-15P Electrical Plug is a 3 blade plug that is commonly found within residential and office environments within the United States.

Notch: As used in this disclosure, a notch is: 1) an indentation formed in an edge; or 2) a cavity or aperture formed within a surface.

One to One: When used in this disclosure, a one to one relationship means that a first element selected from first set is in some manner connected to only one element of a second set. A one to one correspondence means that the one to one relationship exists both from the first set the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Socket: As used in this disclosure, a socket is an electrical device that 1) forms an opening or a cavity that acts as a receptacle for an inserted object; and 2) is designed to receive or transfer electricity to or from the object inserted in the socket. A synonym for socket is port.

Slot: As used in this disclosure, a slot is a long narrow groove or aperture that is formed in an object.

Spool: As used in this disclosure, a spool is a cylindrical device upon which a flexible material, including but not limited to a yarn, a cord, or a tape, can be wound. Depending on context, a spool may also contain the flexible material stored upon the spool. Reel is a common synonym for spool.

Supporting Surface: As used in this disclosure, a supporting surface is a horizontal surface upon which an object is placed. Within this disclosure, it is assumed that the object is placed on the supporting surface in an orientation that is appropriate for the normal or anticipated use of the object.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A storage apparatus comprising:

a cord reel and a cord;

wherein the cord is spooled and stored on the cord reel;

wherein the cord is further defined with a first end and a second end;

wherein the center of the cord attaches to the cord reel in such a manner that the first end and the second end of the cord are simultaneously played out from the cord reel when the storage apparatus is being deployed;

wherein the center of the cord attaches to the cord reel in such a manner that the first end and the second end of the cord are simultaneously spooled on to the cord reel when the storage apparatus is being retracted;

wherein the cord reel comprises a bifurcated spool and a stand;

wherein the bifurcated spool attaches to the stand;

wherein the cord is stored on the bifurcated spool;

wherein the bifurcated spool comprises a first end flange storage location and a second end flange storage location within and between which the cord is equally divided during storage;

wherein the bifurcated spool comprises a drum, a first end flange, a second end flange, a bifurcating flange, and a crank;

wherein the first end flange, the second end flange, the bifurcating flange and the crank are attached to the drum;

wherein the first end flange is further defined with a flange diameter;

wherein the second end flange is further defined with a flange diameter;

wherein the bifurcating flange is further defined with a flange diameter;

wherein the spans of the flange diameter of each of the first end flange, the second end flange, and the bifurcating flange are identical;

wherein the first end flange and the second end flange are identical;

wherein the drum is a structure shaped as a right cylinder;

wherein the drum forms the surface upon which the cord is spooled;

wherein the first end flange is a circular disk that attaches to a base of the cylindrical structure that forms the drum;

wherein the second end flange is a circular disk that attaches to the base of the cylindrical structure that forms the drum that is distal from the first end flange;

wherein the bifurcating flange is a circular disk that attaches to the drum;

wherein the bifurcating flange is positioned on the drum such that the faces of the bifurcating flange are parallel to the faces of the first end flange and the second end flange;

wherein the bifurcating flange is positioned on the drum such that the span of the distance from the bifurcating flange to the first end flange equals the span of the distance from the bifurcating flange to the second end flange;

wherein the bifurcating flange divides the bifurcated spool into the first end flange storage location and the second end flange storage location;

wherein the drum comprises a drum shaft;

wherein the drum shaft is a cylindrical shaft that is attached to the drum such that the center axis of the drum shaft is aligned with the center axis of the drum;

wherein the drum shaft attaches to the crank such that the drum shaft forms a crankshaft that rotates the drum such that the axis of rotation of the drum is aligned with the center axis of the drum;

wherein the crank is a shaft that rotates the drum shaft;

wherein the bifurcating flange comprises a slot and a notch;

wherein the notch is formed in the slot;

wherein the slot is further defined with an inner dimension;

wherein the inner dimension is the span of the negative space formed by the slot;

wherein the inner dimension is measured in a direction that is perpendicular the radial axis of the slot;

wherein the slot is a radial groove that is formed through the faces of the bifurcating flange such that the slot forms an opening in the circumference of the bifurcating flange;

wherein the notch is an opening that is formed at the junction of the drum and the slot;

wherein the notch projects in a perpendicular direction from the slot;

wherein the stand is a structural frame that supports the bifurcated spool above the supporting surface such that the bifurcated spool can be rotated;

wherein the stand comprises a first triangular plate, a second triangular plate, a first cross brace, and a second cross brace;

wherein the first triangular plate and the second triangular plate are identical;

wherein the first triangular plate is further defined with a first height;

wherein the second triangular plate is further defined with a second height the span of which is identical to the span of the height of the first triangular plate;

wherein henceforth the first height and the second height are referred to as the height;

wherein the height is the perpendicular vertical distance as measured from the vertex of a selected triangular plate;

wherein the selected vertex is the vertex that is distal to the supporting surface;

wherein the triangular plate is selected from the group consisting of the first triangular plate and the second triangular plate;

wherein the span of the height is independent of the selected triangle;

wherein the span of the height is greater than the span of the flange diameter;

wherein the first triangular plate is a triangular plate structure that supports the first end flange of the bifurcated spool;

wherein the second triangular plate is a triangular plate structure that supports the second end flange of the bifurcated spool;

wherein the first triangular plate further comprises a first bearing;

wherein the second triangular plate further comprises a second bearing;

wherein the first bearing is a bearing that is mounted through the first triangular plate such that the first bearing supports an end of the drum shaft in such a manner that the drum shaft can be connected to the crank;

wherein the second bearing is a bearing that is mounted on the second triangular plate such that the first bearing supports an end of the drum shaft;

wherein the first cross brace is a strut that attaches a first vertex of the first triangular plate to the corresponding vertex of the second triangular plate;

wherein the second cross brace is a strut that attaches a second vertex of the first triangular plate to the corresponding vertex of the second triangular plate;

wherein the cord refers to a long, thin, and flexible object;

wherein the cord has the flexibility to allow the cord to be wrapped around a cylindrical structure;

wherein the cord is further defined with the first end, the second end, and an outer dimension;

wherein the cord further comprises a center mark;

wherein the outer dimension is a measure of the diameter across the cord;

wherein the center mark is an image that is formed on the cord;

wherein the center mark identifies the linear center point of the cord such that the span of the distance from the center mark to the first end equals the span of the distance from the center mark to the second end.

2. The storage apparatus according to claim 1 wherein the span of the outer dimension of the cord is lesser than the inner dimension of the slot such that the cord can be inserted into the slot;

wherein the center mark of the cord is inserted into the slot to the center of the cord to the drum;

wherein the center mark of the cord is placed in the notch in order to secure the cord to the cord reel.

3. The storage apparatus according to claim 2 wherein the cord comprises an electrical cable, a first termination, and a second termination;

wherein the electrical cable is an electrically conductive structure;

wherein the first termination is a NEMA 5-15 electrical socket that is attached to the first end of the electrical cable;

wherein the second termination is a NEMA 5-15 electrical plug that is attached to the second end of the electrical cable.

* * * * *